US007721849B2

(12) United States Patent
Graffy et al.

(10) Patent No.: US 7,721,849 B2
(45) Date of Patent: May 25, 2010

(54) RETRACTABLE LADDER

(76) Inventors: Thomas Graffy, 1125 Capri Way, Oxnard, CA (US) 93035; Stepan Gevorkyan, 1348 Thompson St., Glendale, CA (US) 91201

( * ) Notice: Subject to any disclaimer, the term of this patent is extended or adjusted under 35 U.S.C. 154(b) by 632 days.

(21) Appl. No.: 11/581,195

(22) Filed: Oct. 12, 2006

(65) Prior Publication Data

US 2008/0087496 A1 Apr. 17, 2008

(51) Int. Cl.
*E06C 5/00* (2006.01)

(52) U.S. Cl. ..... 182/97; 182/127

(58) Field of Classification Search ..... 182/127, 182/97, 96; 280/166
See application file for complete search history.

(56) References Cited

U.S. PATENT DOCUMENTS

| | | | | |
|---|---|---|---|---|
| 304,821 | A * | 9/1884 | Hofele | 182/84 |
| 2,794,583 | A | 6/1957 | Ernst | |
| 3,379,280 | A * | 4/1968 | Pace | 182/96 |
| 3,601,220 | A | 8/1971 | Saucher | |
| 3,869,022 | A * | 3/1975 | Wallk | 182/96 |
| 4,189,028 | A * | 2/1980 | Reinhard | 182/160 |
| 5,033,582 | A | 7/1991 | Hoben | |
| 5,330,084 | A * | 7/1994 | Peters | 224/506 |
| 6,013,545 | A | 1/2000 | Falcide | |
| 6,378,654 | B1 | 4/2002 | Ziaylek, Jr. et al. | |
| 6,468,188 | B1 * | 10/2002 | Koenig | 482/97 |
| 7,195,262 | B2 * | 3/2007 | Chaudoin et al. | 280/166 |
| 7,401,798 | B2 * | 7/2008 | Dolan | 280/163 |

* cited by examiner

*Primary Examiner*—Alvin C Chin-Shue
(74) *Attorney, Agent, or Firm*—Kenneth L. Green

(57) ABSTRACT

A retractable ladder for a motorhome or trailer includes pivoting mounting apparatus providing total support for a ladder and climber in an open position. The apparatus includes brackets which mount on the side of the motorhome or trailer and arms which pivot in the brackets. The brackets mount to the sides of the motorhome or trailer only and therefore do not compromise the roof of the motorhome or trailer. The ladder attaches to the ends of the arms. The brackets include flanges which the arms rest against in the open position and pins for retaining the arms in the open position, thereby eliminating any need for the ladder to be supported by the ground. The pins may further be inserted through the brackets to retain the ladder in a closed position. Backing plates or the like may be provided behind the motorhome or trailer body to securely attach the brackets.

17 Claims, 5 Drawing Sheets

RETRACTABLE LADDER

BACKGROUND OF THE INVENTION

The present invention relates to recreational vehicles and in particular to ladders for accessing the roofs of motorhomes and travel trailers.

There is a desire to provide as much interior space as possible which translates into maximizing the overall motorhome and travel trailer widths. However, increased width makes the motorhome or travel trailer difficult to navigate in narrow passages, and ultimately is limited by highway regulations which limit motorhome and travel trailer width to, for example, 102 inches. Further, many motorhomes and travel trailers provide for roof storage, and also may include roof mounted air conditioning units and/or roof mounted generators. As a result of these uses of the motorhome and travel trailer roofs, there is frequently a desire to provide a ladder to access the motorhome and travel trailer roof.

While ladders might be attached to the rear of a motorhome or trailer, in many instances owners would prefer to mount the ladders on the sides of their motorhomes or trailers to avoid blocking views from rear windows, or in the case of toy haulers with full width rear doors, it is not feasible to mount the ladder to the rear. Unfortunately, due to the aforementioned substantial width of motorhomes and trailers, adding the additional width of known fixed side mounted ladders often violates FMVSF standards, and may result in damage when a driver fails to allow room for the additional width resulting from a fixed side mounted ladder.

Further, known motorhome or trailer ladders include brackets which attach to the motorhome or trailer roofs. Such roof attachment often compromises the roof resulting in leaks. The resulting entrance of moisture into the motorhome or trailer roof may damage the roof and weaken the ladder mounting points in particular. The weakening of the mounting points may result in failure of the roof structure and in injury to a climber.

BRIEF SUMMARY OF THE INVENTION

The present invention addresses the above and other needs by providing a retractable ladder for a motorhome or trailer including pivoting mounting apparatus providing total support for a ladder and climber in an open position. The apparatus includes brackets which mount on the side of the motorhome or trailer and arms which pivot in the brackets. The brackets mount to the sides of the motorhome or trailer only and therefore do not compromise the roof of the motorhome or trailer. The ladder attaches to the ends of the arms. The brackets include flanges which the arms rest against in the open position and pins for retaining the arms in the open position, thereby eliminating any need for the ladder to be supported by the ground. The pins may further be inserted through the brackets to retain the ladder in a closed position. Backing plates or the like may be provided behind the motorhome or trailer body to securely attach the brackets.

In accordance with one aspect of the invention, there is provided a retractable ladder and mounting apparatus comprising brackets for mounting to an approximately vertical surface, a ladder, and pivoting arms connecting the ladder to the brackets. Each arm comprises a pair of laterally spaced apart vertical members having first ends and second ends opposite the first ends. The first ends pivotally connect to the brackets and the arms pivot between an approximately horizontal position and an approximately vertical position. The ladder is pivotally connected to the second ends of the arms and is movable between an open position corresponding to the horizontal position of the arms wherein the ladder may be climbed on, and a closed position corresponding to the vertical position of the arms for storing. Flanges extend laterally outward from opposite lower edges of the brackets and provide a rest for bottom edges of the vertical members of the arms when the arms are in the approximately horizontal position to carry the weight of a climber.

In accordance with another aspect of the invention, there is provided apparatus for retractably mounting a ladder. The apparatus includes brackets mountable to an approximately vertical surface. The brackets include bracket pivot points. Arms connect the ladder to the bracket and include first ends and second ends opposite the first ends. The first ends have arm pivot points pivotally connected to the bracket pivot points and the arms are pivotable about the pivot points between an approximately horizontal position and an approximately vertical position. The ladder comprises laterally spaced apart vertical ladder members supporting steps. The vertical ladder members are pivotally connected to the second ends of the arms allowing the ladder to move between an open position corresponding to the horizontal position of the arms wherein the ladder may be climbed on, and a closed position corresponding to the vertical position of the arms wherein the ladder is stored. The brackets include bracket mouths for receiving the vertical ladder members when the ladder is in the closed position. Bracket assembly pin passages are outwardly spaced apart from bracket pivot points past the vertical ladder members when the ladder is in the closed position and pins may be inserted through the bracket assembly pin passages to retain the ladder in the closed position. The brackets include at least one bracket stop feature and the arms include at least one arm stop feature. The stop features are positioned so that when the arms are in the approximately horizontal position, the at least one arm stop feature rests against the at least one bracket stop feature to carry the weight of the ladder and of a climber.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
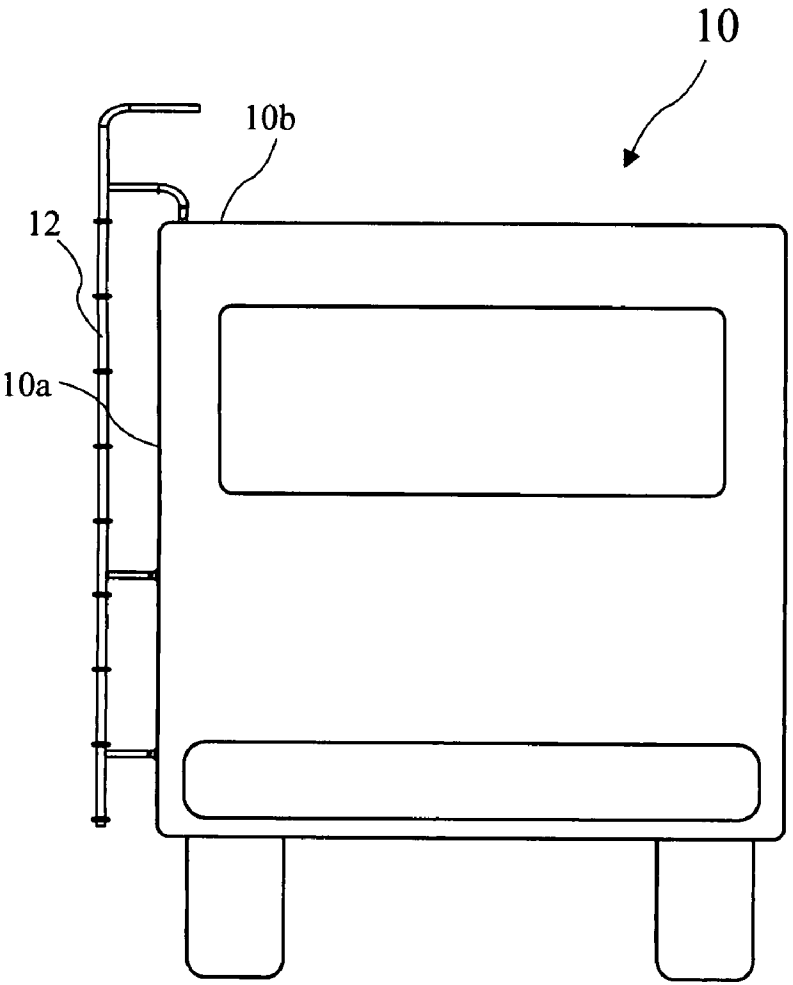
FIG. 1 (prior art)
FIG. 1 is a prior art ladder mounted to the side and roof of a motorhome or trailer.

A prior art ladder 12 mounted to the side 10*a* and roof 10*b* of a motorhome or trailer 10 is shown in FIG. 1. Highway regulations limit the maximum width of motorhomes and trailers to, for example, 102 inches. Unfortunately, the ladder 12 extends laterally from the side 10*a*, and may result in a vehicle width which violates highway regulations. The ladder 12 mounting to the roof 10*b* may also compromise the roof resulting in leaks and potentially weakening the roof. Such weakening of the roof at ladder mounting points may result in a failure and injury to a climber.

Figure 2B:
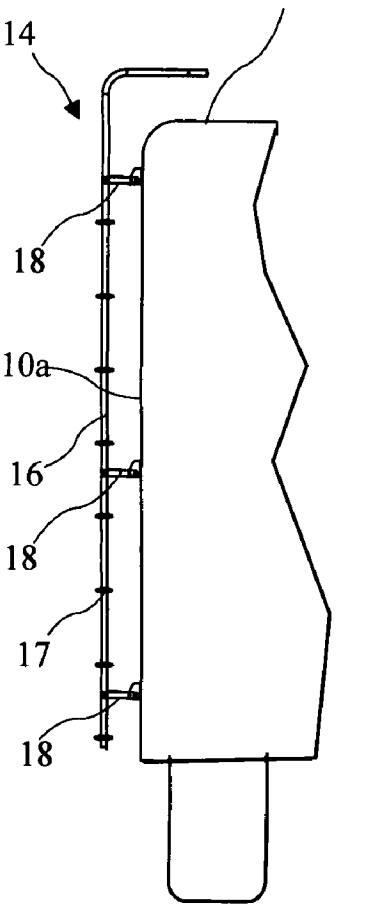
FIG. 2B depicts the retractable ladder according to the present invention in an open position supported above the ground by mounting apparatus attached to the side of a motorhome or trailer.
Figure 2A:
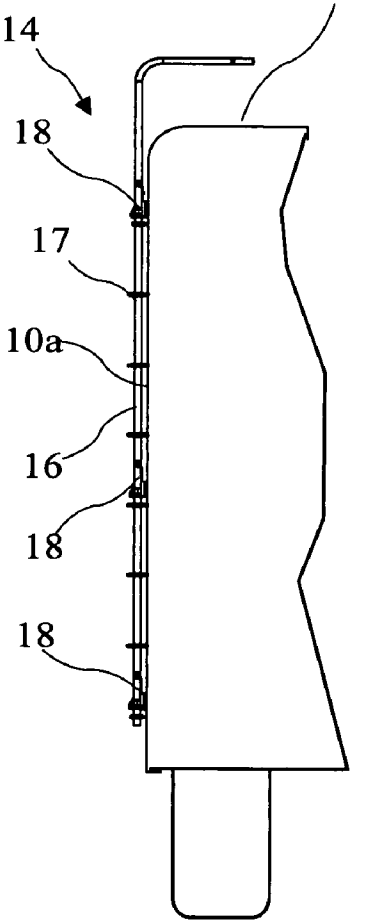
FIG. 2A depicts a retractable ladder according top the present invention in a closed position.

A retractable ladder 14 and mounting apparatus 18 according to the present invention is shown in a closed (or retracted) position in FIG. 2A and in an open position in FIG. 2B. The closed position allows mounting the ladder 14 to the side 10*a* without exceeding a maximum motorhome or trailer width. The open position allows the ladder to be forwardly spaced apart from the side 10*a* sufficiently to allow the ladder to be climbed on. The ladder 14 includes two laterally spaced apart vertical ladder members 16 supported by the mounting apparatus 18, for example supported by three vertically spaced apart pairs of mounting apparatus 18, each pair of mounting apparatus 18 comprising two laterally spaced apart mounting apparatus 18. The vertical ladder members 16 support steps 17. The mounting apparatus 18 provides total support for the ladder 14 and a climber, thereby eliminating any need for the ladder 14 to be supported by the roof 10*b* or by the ground. The sides 10*a* are generally vertical or approximately vertical, however, the present invention may be used with slightly tilted sides.

Figure 3B:
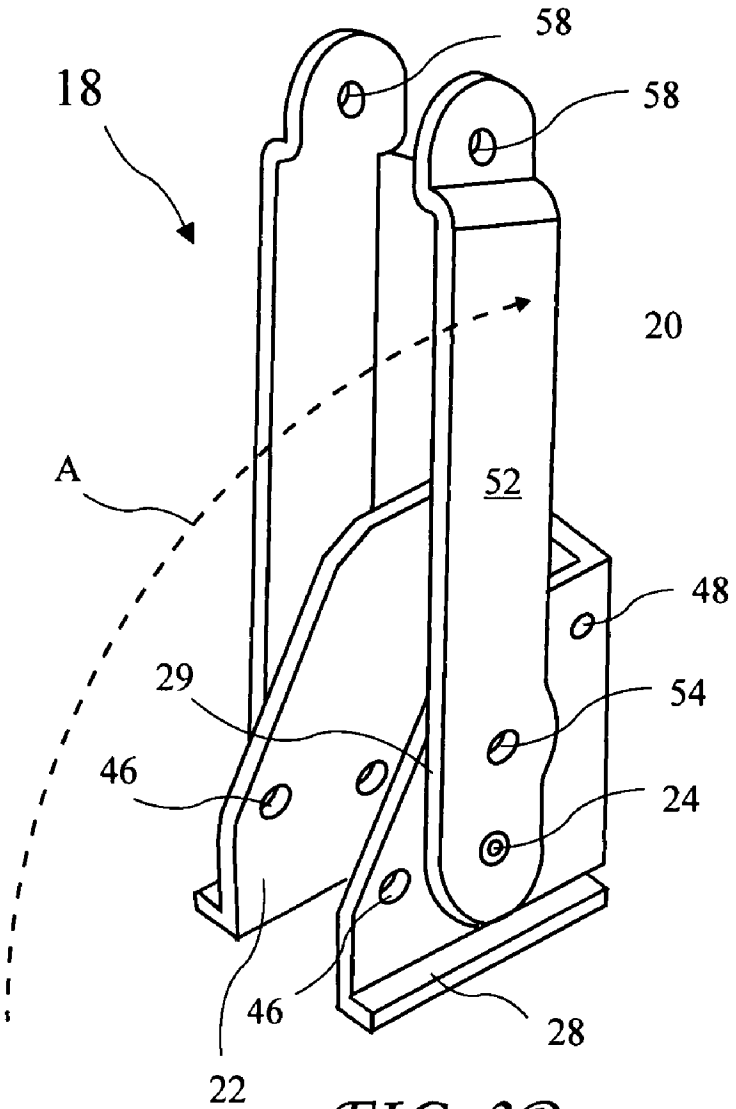
FIG. 3B shows the mounting apparatus comprising the bracket and the arm according to the present invention in the closed position.
Figure 3A:
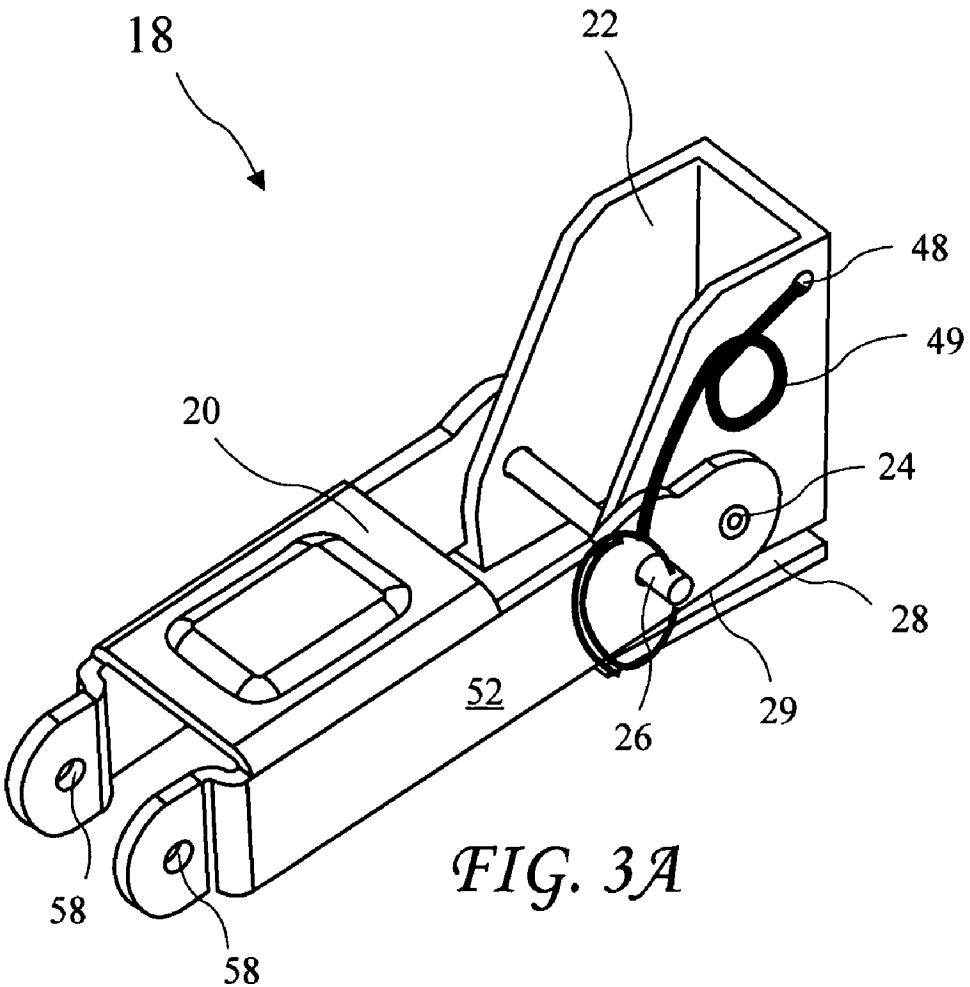
FIG. 3A shows mounting apparatus comprising a bracket and arm according to the present invention in the open position.

Each mounting apparatus 18 according to the present invention comprises a bracket 22 and an arm 20 shown in the open position in FIG. 3A and in the closed position in FIG. 3B. A rotatable fastener 24 (for example, a rivet) passes through arm pivot point 56 (see FIG. 6A) and through a bracket pivot point 44 (see FIG. 5A) to pivotally connect the arm 20 to the bracket 22. The arm 20 may thus pivot along arc A between an approximately horizontal position corresponding to the open position of the mounting apparatus 18 and an approximately vertical position corresponding to the closed position of the mounting apparatus 18. The arms 20 are not necessarily vertical when in the approximately vertical position, and in some embodiments the arms may be tilted away from vertical when the mounting apparatus 18 is in the closed position depending on the location of the bracket pivot point 44. The arms 20 further include ladder pivot points 58 (see FIG. 6A) for pivotally connecting the vertical ladder members 16 to the arms 20.

The mounting apparatus 18 provides at least one bracket stop feature and at least one arm stop feature so that when the arms 20 are in an approximately horizontal position the at least one arm stop feature rests against the at least one bracket stop feature, and such resting is sufficient to carry the weight of the ladder 14 and of a climber. Preferably, the stop features are sufficient to carry any weight climber and a ladder 14 mounted using the mounting apparatus 18 has been tested to carry 600 pounds. An example of a bracket stop feature is a pair of flanges 28 extending laterally outward from opposite lower edges of sides 22*a* (see FIG. 5*a*) of the bracket 22. The flanges 29 reside directly below lower edges 29 of vertical members 52 of the arms 20 as the arms 20 approach the open position. The stops permits the ladder 14 to be used in an open position without requiring the ladder to be supported by the ground or any other additional support.

Figure 5:
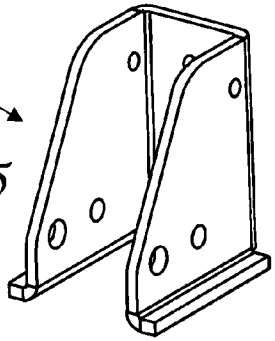
FIG. 5 is a perspective view of the bracket.
Figure 5D:
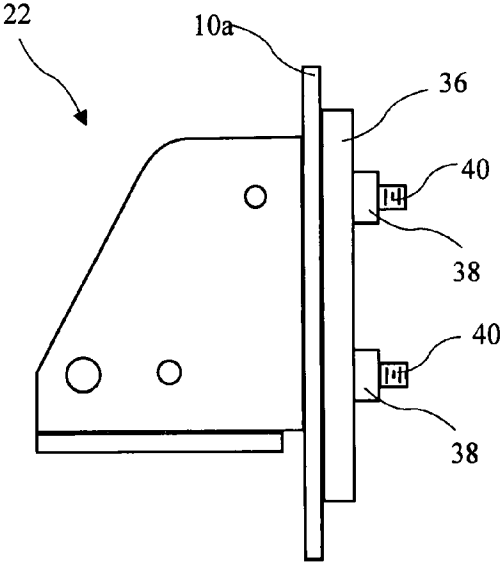
FIG. 5D is a side view of the bracket mounted to an approximately vertical surface of a motorhome or trailer.
Figure 5B:
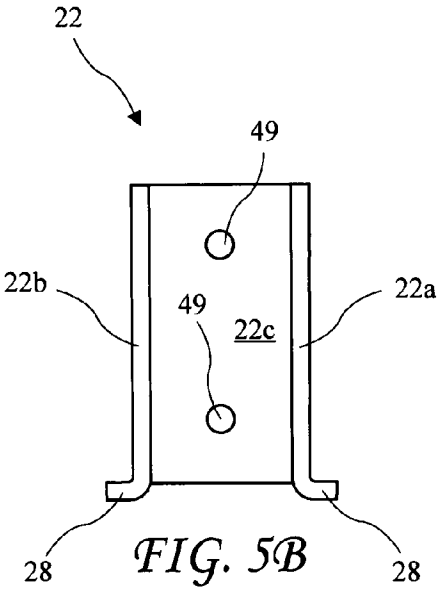
FIG. 5B is a front view of the bracket.
Figure 5C:
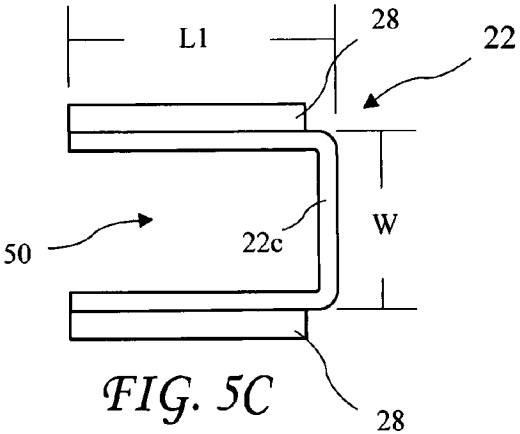
FIG. 5C is a top view of the bracket.
Figure 5A:
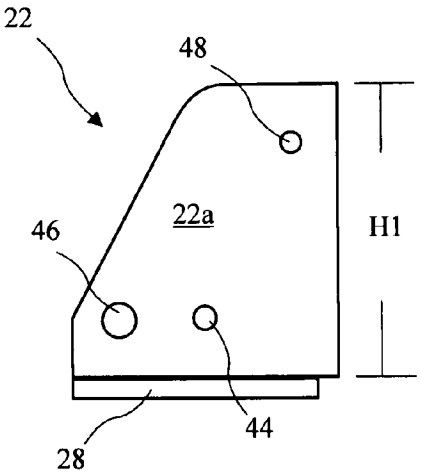
FIG. 5A is a side view of the bracket.

Bracket assembly pin passages 46 on the sides 22*a* and 22*b* of the bracket 22 are forwardly spaced apart from the bracket pivot points 44 (see FIG. 5A). The arms 20 include arm assembly pin passages 54 forwardly (or upwardly in the closed position) spaced apart from the arm pivot points 56 (see FIG. 6A) which may be aligned with the bracket assembly pin passages 46 when the arms 22 are in the open position, and a pin 26 inserted therethrough. A lanyard 49 may be connected between the pin 26 and a lanyard hole 48 to prevent loss of the pin 26.

Figure 4B:
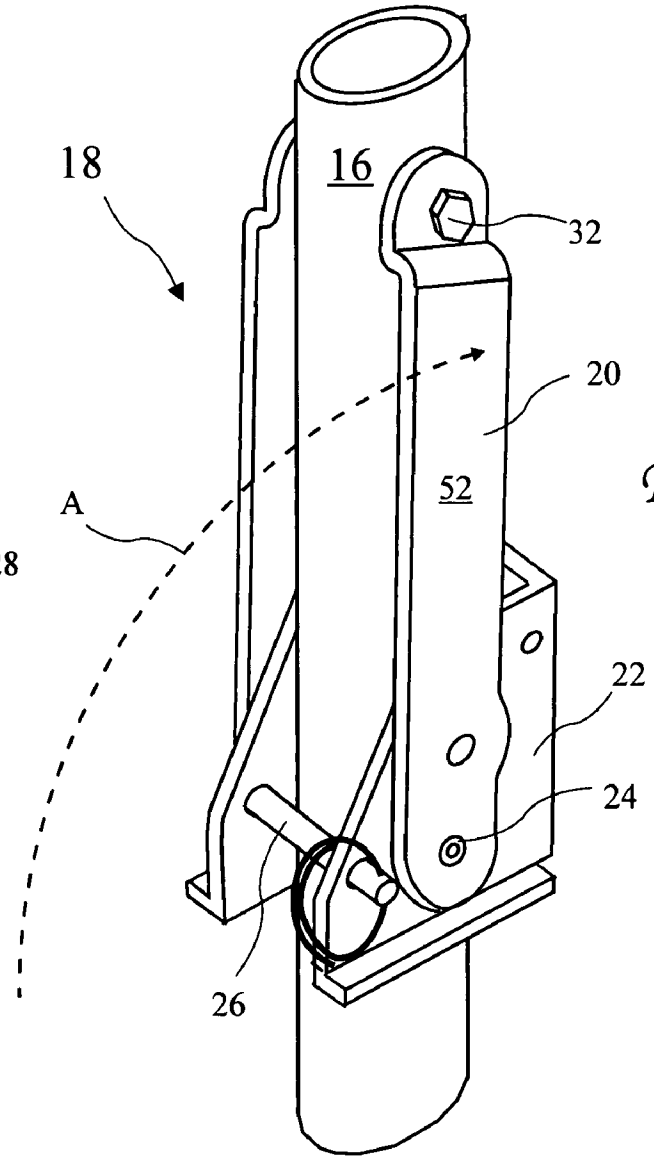
FIG. 4B shows the mounting apparatus according to the present invention supporting the vertical ladder member in the closed position.
Figure 4A:
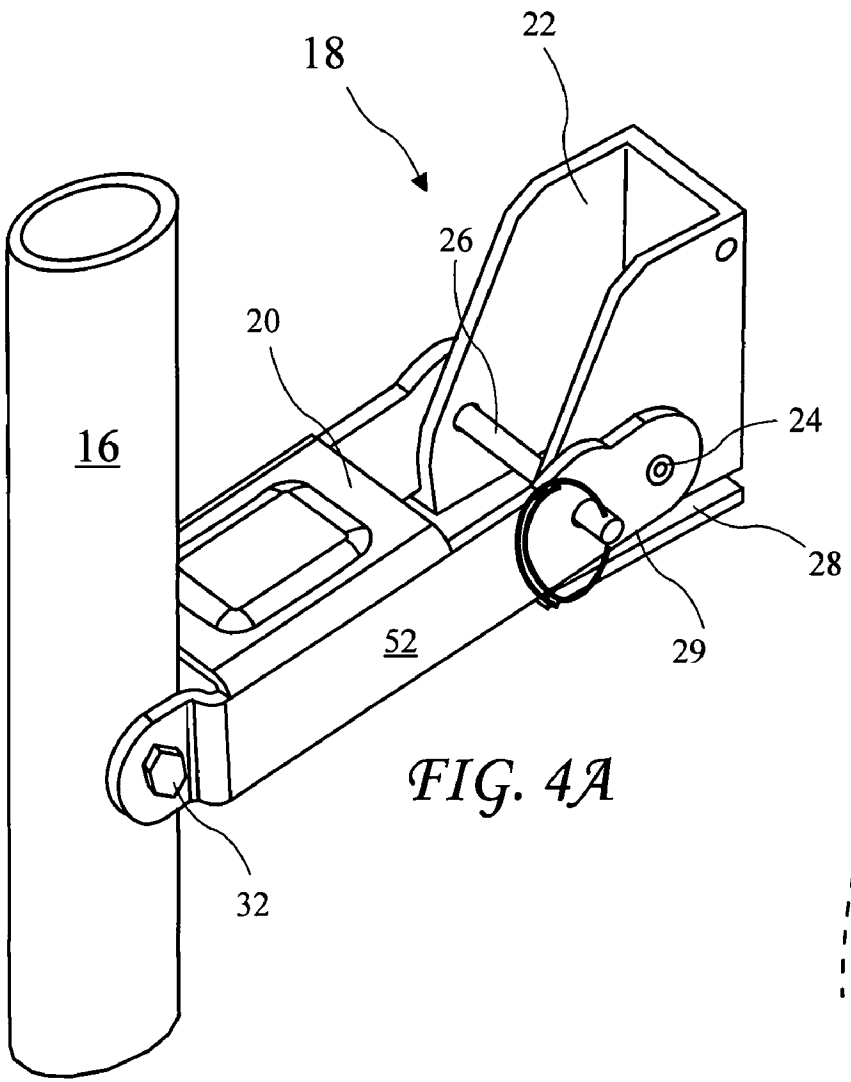
FIG. 4A shows the mounting apparatus according to the present invention supporting a vertical ladder member in the open position.

The arm 20 and the bracket 22 are shown supporting the vertical ladder member 16 in FIG. 4A in the open position and supporting the vertical ladder member 16 in the closed position in FIG. 4B. The vertical ladder member 16 is pivotally connected to the second end 20*a* (see FIG. 6A) of the arm 20 by a fastener 32, which fastener 32 is preferably a bolt and locknut, for example, a bolt and a nut with a nylon insert. The pin 26 is shown inserted through the bracket assembly pin passages 46 and retaining the vertical ladder member 16 in the closed position in FIG. 4B.

A perspective view of the bracket 22 is shown in FIG. 5, a side view of the bracket 22 is shown in FIG. 5A, a front view of the bracket 22 is shown in FIG. 5B, a top view of the bracket 22 is shown in FIG. 5C, and a side view of the bracket 22 mounted to an approximately vertical surface 10*a* of a motorhome or trailer 10 is shown in FIG. 5D. The bracket 22 includes laterally spaced apart bracket sides 22*a* and 22*b* and flanges 28 extending laterally outward from opposite lower edges of the bracket sides 22*a* and 22*b*. The bracket sides 22*a* and 22*b* are approximately vertical when mounted.

The bracket sides 22*a* and 22*b* include bracket pivot points (or holes) 44 for pivotally connecting the arms 20 (see FIGS. 3A, 3B, 4A, 4B) to the brackets 22. The bracket sides 22*a* and 22*b* further include the bracket assembly pin passages 46 forward of the bracket pivot points 44, and lanyard holes 48. A bracket back side 22*c* of the bracket 22 includes mounting holes 49 for mounting to the side 10*a* of a motorhome or trailer 10. The bracket is preferably mounted using fasteners cooperating with a backing plate 36 behind the side 10*a*. An example of suitable fasteners are a bolt 40 threaded into a nut 38.

The brackets 22 have a length L1, a height H1, and a width W. The length L1 is preferably approximately 2.3 inches, the height H1 is preferably approximately 2.5 inches, and the width W is preferably approximately 1.5 inches.

Figure 6:
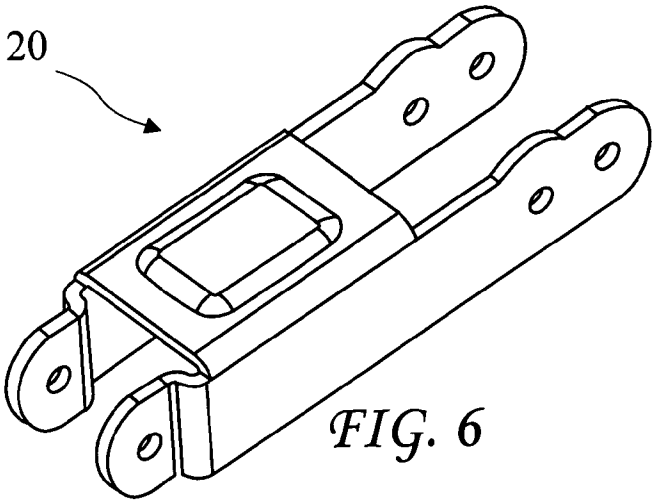
FIG. 6 is a perspective view of the arm.
Figure 6B:
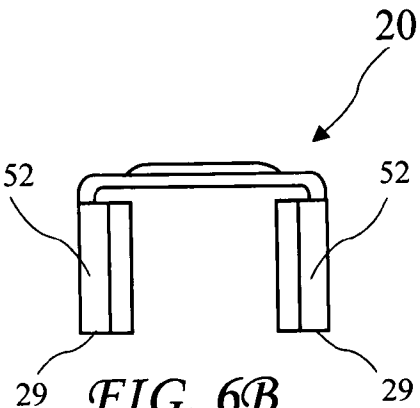
FIG. 6B is a front view of the arm.
Figure 6C:
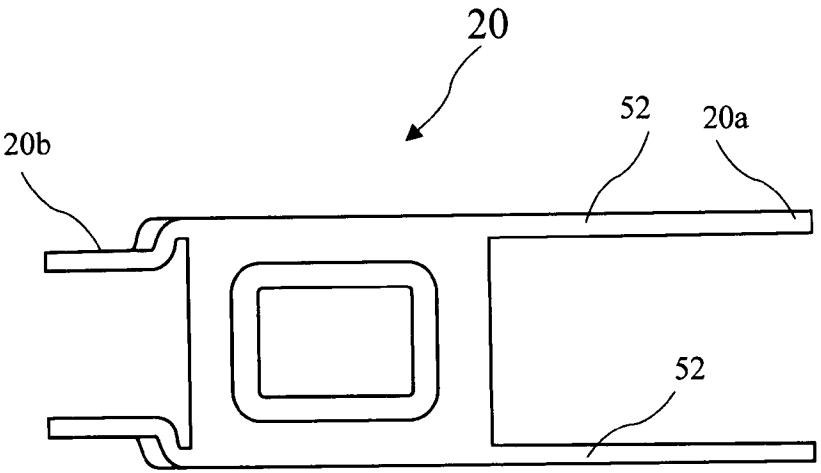
FIG. 6C is a top view of the arm.
Figure 6A:
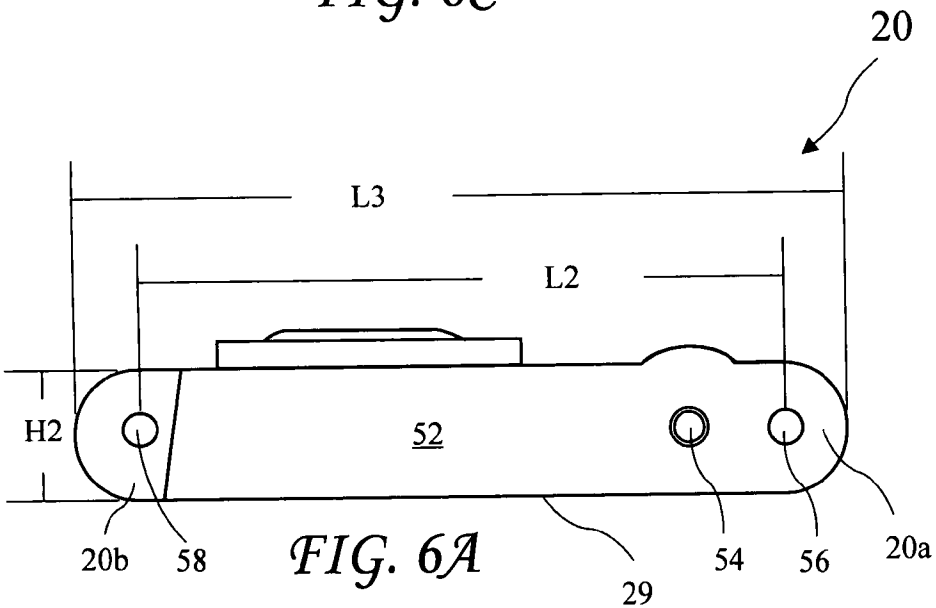
FIG. 6A is a side view of the arm.

A perspective view of the arm 20 is shown in FIG. 6, a side view of the arm 20 is shown in FIG. 6A, a front view of the arm 20 is shown in FIG. 6B, and a top view of the arm 20 is shown in FIG. 6C. The arm 22 includes a pair of laterally spaced apart vertical members 52 having first ends 20*a* and second ends 20*b* opposite the first ends 20*a*. The first ends 20*a* are pivotally connected to the brackets 22 by the arm pivot points (or holes) 56 cooperating with the bracket pivot points 44. The second ends 20*b* pivotally connect to the ladder vertical members 16 at the ladder pivot points 58. The arm pivot points 56 are separated from the ladder pivot points 58 by a pivot length L2 which is preferably approximately five inches and the arm 20 has an overall length L3 which is preferably approximately six inches. Arm assembly pin passages 54 are forwardly spaced apart from the arm pivot points 56. The vertical members 52 have a height H2 which is preferably approximately one inch. The arms 20 and the brackets 22 are preferably made from approximately 0.015 inch thick carbon steel, zinc plated, and powder coated.

While the invention herein disclosed has been described by means of specific embodiments and applications thereof, numerous modifications and variations could be made thereto by those skilled in the art without departing from the scope of the invention set forth in the claims.

We claim:

1. A retractable ladder comprising:

at least two vertically spaced apart pairs of mounting apparatus, each mounting apparatus comprising:

a bracket for mounting to an approximately vertical surface, each bracket including laterally spaced apart bracket sides, each bracket side including a bracket pivot point, a bracket pin passage spaced apart from the bracket pivot point, and horizontally outward reaching flanges along lower edges of each of the bracket sides; and an arm, each arm comprising a spaced apart pair of vertical arm members residing outside the bracket sides and having first ends and second ends opposite the first ends, the first ends pivotally connected at arm pivot points to the bracket pivot points, the arms pivoting between an approximately horizontal position and an approximately vertical position, the vertical arm members including arm pin passages spaced apart from the arm pivot points towards the second end, and the vertical arm members including lower edges which come to rest against the flanges of the bracket sides when the arms are in the approximately horizontal position; and a ladder comprising laterally spaced apart vertical ladder members and horizontal steps connecting the vertical ladder members, the second ends of each of the arms pivotally connected to the ladder at respective ladder pivot points on respective vertical ladder members, the ladder remaining approximately vertical over a full range of movement of the ladder, translating without rotating and moving between an open position corresponding to the approximately horizontal position of the arms and the ladder forwardly spaced apart from the approximately vertical surface sufficiently to allow the ladder to be climbed on, wherein the lower edges of the vertical arm members and the flanges of the bracket sides cooperate to carry the weight of the ladder and a climber and each mounting apparatus including a pin simultaneously insertable through the bracket pin passages and the arm pin passages to retain the ladder in the open position; and a closed position corresponding to the approximately vertical position of the arms, with the vertical ladder members residing in a respective bracket between its bracket sides for storing the ladder, with the pins insertable through the bracket pin passages and the vertical ladder members residing behind the pins to retain the ladder in the closed position.

2. The apparatus of claim 1, wherein each bracket includes a mouth between the two bracket sides for receiving the vertical ladder members when the ladder is in the closed position.

3. The apparatus of claim 1, wherein laterally spaced apart pair of vertical arm members are connected by a lateral top portion connecting top edges of the pair of vertical arm members when the vertical arm members are approximately horizontal; and the lateral top portions and pair of vertical arm members form a vertical channel receiving the ladder vertical members when the ladder is in the stored position.

4. The apparatus of claim 1, wherein the flanges extend laterally outward from the lower edges of the bracket sides.

5. The apparatus of claim 1, wherein the arms have a common pivot length L2 between the arm pivot points and the ladder pivot points.

6. The apparatus of claim 5, wherein the pivot length L2 is approximately five inches.

7. The apparatus of claim 1, wherein the at least two vertically spaced apart pairs of mounting apparatus comprises three vertically spaced apart pairs of mounting apparatus.

8. A retractable ladder comprising:

at least two vertically spaced apart pairs of mounting apparatus, each mounting apparatus comprising:

a bracket for mounting to an approximately vertical surface, the bracket including two parallel laterally spaced apart bracket sides reaching out from the approximately vertical surface, each bracket side including a bracket pivot point; and an arm including a pair of laterally spaced apart vertical side members residing outside the bracket sides having first ends and second ends opposite the first ends, the first ends including arm pivot points pivotally connected to the bracket sides at the bracket pivot points, the arm pivoting between an approximately horizontal position and an approximately vertical position by pivoting around the arm pivot points, the vertical side members also including arm assembly pin passages spaced apart from the arm pivot points towards the second ends;

a ladder comprising steps and vertical ladder members supporting the steps, the vertical ladder members pivotally connected to the second ends of the arms at respective ladder pivot points on respective vertical ladder members, the ladder moving between an open position corresponding to the approximately horizontal position of the arms wherein the ladder may be climbed on and a closed position corresponding to the approximately vertical position of the arms for storing the ladder, with the vertical ladder members residing in a respective bracket between its bracket sides;

flanges reaching laterally out from lower edges of each bracket side and providing a rest for bottom edges of the vertical side members of each arm when the arms are in the approximately horizontal position to carry the weight of a climber; and bracket assembly pin passages in the bracket sides, wherein the bracket assembly pin passages are outwardly spaced apart from the bracket pivot points past the vertical ladder members when the ladder is in the closed position and the arms are in the approximately vertical position, with each mounting apparatus including a pin insertable through the bracket assembly pin passages to restrict lateral motion of the ladder from the closed to the open position; and the bracket assembly pin passages are alignable with the arm assembly pin passages when the arms are in the approximately horizontal position and the ladder is in the open position, with the pin insertable simultaneously through the bracket assembly pin passages and the arm assembly pin passages for retaining the ladder in the open position.

9. The apparatus of claim 8, wherein the arms have a common pivot length L2 between the arm pivot points and the ladder pivot points.

10. The apparatus of claim 9, wherein the pivot length L2 is approximately five inches.

11. The apparatus of claim 8, wherein the at least two vertically spaced apart pairs of mounting apparatus comprises three vertically spaced apart pairs of mounting apparatus.

12. The apparatus of claim 8, wherein:

the vertical side members of the arms are connected by a lateral top portion connecting top edges of the vertical side members when the arms are approximately horizontal; and the lateral top portions and vertical side members forming a vertical channel receiving the ladder vertical members when the ladder is in the stored position.

13. A ladder for mounting on sides of motor homes and trailers, the ladder comprising:

at least two vertically spaced apart pairs of mounting apparatus, each mounting apparatus comprising:

a bracket mounted to an approximately vertical surface of a vehicle selected from a group consisting of a motor home and a trailer, the bracket including two parallel laterally spaced apart bracket sides reaching out from the approximately vertical surface, each bracket side including a bracket pivot point; and an arm having vertical side members residing outside the bracket sides and the vertical side members each having a first end and a second end opposite the first end, the first ends having arm pivot points pivotally connected to the bracket pivot points, the arm pivotable about the arm pivot points between an approximately horizontal position and an approximately vertical position, the vertical side members further including arm pin passages spaced apart from the arm pivot points towards the second end;

a ladder comprising laterally spaced apart vertical ladder members supporting steps, the vertical ladder members pivotally connected to respective second ends of the arms at respective ladder pivot points, the ladder moving between:

an open position corresponding to the approximately horizontal position of the arms and the steps laterally spaced apart from the approximately vertical surface sufficiently to allow the ladder to be climbed on; and a closed position corresponding to the approximately vertical position of the arms for storing the ladder and the vertical ladder members residing in a respective bracket between its bracket sides;

bracket pin passages in the bracket sides, the bracket pin passages outwardly spaced apart from the bracket pivot points past the vertical ladder members when the ladder is in the closed position and the arms are in the approximately vertical position, the mounting apparatus including a pin insertable laterally through the bracket pin passages of each bracket to restrict lateral motion of the ladder from the closed to the open position;

the bracket pin passages alignable with the arm pin passages in the arm when the ladder is in the open position and the arm is in the approximately horizontal position, the pin simultaneously insertable through the bracket pin passages and the arm pin passages to retain the ladder in the open position;

each bracket including a bracket stop feature comprising horizontally outward reaching flanges along lower edges of each of the bracket sides; and the arms cooperating with the bracket stop features when the ladder is in the open position to carry the weight of the ladder and of a climber.

14. The apparatus of claim 13, wherein the arms have a common pivot length L2 between the arm pivot points and the ladder pivot points.

15. The apparatus of claim 14, wherein the pivot length L2 is approximately five inches.

16. The apparatus of claim 14, wherein the at least two vertically spaced apart pairs of mounting apparatus comprises three vertically spaced apart pairs of mounting apparatus.

17. The apparatus of claim 14, wherein:

the vertical side members of the arms are connected by a lateral top portion connecting top edges of the vertical side members when the arms are approximately horizontal; and the lateral top portions and vertical side members form a vertical channel receiving the ladder vertical members when the ladder is in the stored position.

* * * * *